US006962411B2

(12) United States Patent
West et al.

(10) Patent No.: US 6,962,411 B2
(45) Date of Patent: Nov. 8, 2005

(54) ANTI-WICKING CATCHER ARRANGEMENT FOR A SOLVENT INK PRINTHEAD

(75) Inventors: Kenneth J. West, Dayton, OH (US); Jay D. Frazier, Jamestown, OH (US); David A. Huliba, Centerville, OH (US); Bruce A. Bowling, Beavercreek, OH (US); Charles D. Rike, Lebanon, OH (US)

(73) Assignee: Eastman Kodak Company, Rochester, NY (US)

( * ) Notice: Subject to any disclaimer, the term of this patent is extended or adjusted under 35 U.S.C. 154(b) by 22 days.

(21) Appl. No.: 10/335,700

(22) Filed: Jan. 2, 2003

(65) Prior Publication Data

US 2004/0130590 A1 Jul. 8, 2004

(51) Int. Cl.[7] ..... B41J 2/185
(52) U.S. Cl. ..... 347/90; 347/89; 347/76
(58) Field of Search ..... 347/22–36, 77, 347/89, 90

(56) References Cited

U.S. PATENT DOCUMENTS

| | | | | |
|---|---|---|---|---|
| 3,836,914 A | | 9/1974 | Duffield | |
| 4,035,811 A | | 7/1977 | Paranjpe | |
| 4,360,817 A | | 11/1982 | Arway et al. | |
| 4,667,207 A | * | 5/1987 | Sutera et al. | 347/90 |
| 5,337,071 A | * | 8/1994 | East et al. | 347/77 |
| 5,739,829 A | * | 4/1998 | Loyd | 347/17 |
| 6,234,620 B1 | | 5/2001 | Faisst, Jr. et al. | |
| 6,592,213 B2 | * | 7/2003 | Long | 347/90 |
| 6,742,876 B2 | * | 6/2004 | Enz | 347/75 |

FOREIGN PATENT DOCUMENTS

| | | |
|---|---|---|
| EP | 0 561 205 | 9/1993 |
| EP | 0 805 039 | 11/1997 |
| EP | 1 186 424 | 3/2002 |

* cited by examiner

*Primary Examiner*—Shih-Wen Hsieh
(74) *Attorney, Agent, or Firm*—Barbara Joan Haushalter

(57) ABSTRACT

A catcher design is provided wherein vacuum channels are added to both sides of the catcher to remove ink from the face of the catcher and from the eyelid seal. An additional fluid port on the catcher allows the additional vacuum channels to maintain an increased level of vacuum. A restriction on the catcher line balances the fluid flow between the catcher and the additional vacuum channels. A scoop can be machined into the catch pan to remove fluid from below the catcher face. A manifold can be used to maintain a vacuum source for the catcher throat and the additional channels, while pulling the unprinted ink back to the fluid system. Finally, a wider eyelid seal can allow purge fluid used during shutdown to clear the channels.

16 Claims, 5 Drawing Sheets

ANTI-WICKING CATCHER ARRANGEMENT FOR A SOLVENT INK PRINTHEAD

TECHNICAL FIELD

The present invention relates to continuous ink jet printing systems and, more particularly, to a catcher design for a solvent based ink printing system, to prevent ink from wicking out of the catcher throat.

BACKGROUND ART

Ink jet printing systems are known in which a printhead defines one or more rows of orifices which receive an electrically conductive recording fluid from a pressurized fluid supply manifold and eject the fluid in rows of parallel streams. Printers using such printheads accomplish graphic reproduction by selectively charging and deflecting the drops in each of the streams and depositing at least some of the drops on a print receiving medium, while others of the drops strike a drop catcher device.

Over the years, a number of inkjet printers using binary array continuous inkjet printing have been developed, with continuing improvements in speed, reliability, and ease of use. These printers are used in a variety of print applications, often using aqueous inks. Aqueous inks have a viscosity of approximately 1.0 cps and a surface tension of 42.0 dynes/cm. These inks create a uniform fluid film on the face of the catcher that is controlled and directed at a slot on the bottom of the catcher.

In spite of advances in aqueous ink technology, solvent inks, such as ethanol or MEK based inks, are preferred for some applications. For example, in applications such as printing on metals or plastics, solvent inks are preferred over aqueous inks as a result of the solvent ink characteristics of being much faster drying and more permanent than aqueous inks. Solvent inks, having a much lower surface tension (approximately 24 dynes/cm) create a fluid film on the face of the catcher that is much more difficult to control. As this film enters the throat of the catcher, the ink wicks up away from the throat creating a dripping effect during normal operation. This dripping of ink creates a need for an improved design that will eliminate the wicking of ink.

It is seen then that there is a need for an improved anti-wicking arrangement which overcomes the problems associated with the prior art.

SUMMARY OF THE INVENTION

This need is met by the anti-wicking catcher design according to the present invention, wherein ink wicking outward on the catcher face is eliminated. The present invention allows a solvent based ink jet printing system to maintain high printhead reliability and reduce the chance for print defects that can be caused by dripping or wicking ink.

In accordance with one aspect of the present invention, a catcher design is provided wherein vacuum channels are added to both sides of the catcher to remove ink from the face of the catcher and from the eyelid seal. An additional fluid port on the catcher allows the additional vacuum channels to maintain an increased level of vacuum. A restriction on the catcher line balances the fluid flow between the catcher and the additional vacuum channels. A scoop can be machined into the catch pan to remove fluid from below the catcher face. A manifold can be used to maintain a vacuum source for the catcher throat and the additional channels, while pulling the unprinted ink back to the fluid system.

Other objects and advantages of the invention will be apparent from the following description, the accompanying drawings and the appended claims.

DETAILED DESCRIPTION OF THE PREFERRED EMBODIMENTS

The present invention proposes an improved catcher design for controlling the flow of unprinted ink and eliminating wicking our of the catcher throat. In existing printheads, ink drops are deflected onto the face of the catcher. The ink then flows down the face of the catcher, rounding the radius at the bottom of the catcher and entering the catcher throat, from where it can be evacuated. With low surface tension inks, such as solvent based inks, there can be some lateral spreading of the ink as it flows down the catcher face, due to the wicking nature of such inks. An air-ink interface forms inside the catcher throat, with ink filling the inner portion of the catcher throat. As ink is being evacuated from the catcher, the air-ink interface, rather than remaining static, moves in and out, causing air bubbles to occasionally be drawn into the ink. In certain operating conditions, this air-ink interface can become unstable as a result of ingesting air, causing ink to spit out of the catcher throat. Even when the air-ink interface is not so unstable as to spit ink out of the catcher throat, the oscillations of the interface can cause ink to be deposited on the face of the catcher outside the catcher throat, on each side of the impact created by the deflected array of jets. With low surface tension inks that are more prone to spread on the catcher face, and with continued transfers of small amounts of ink onto the catcher face by the oscillations of the air-ink interface in the throat, these ink bulges can spread out as far as the eyelid seal. Ink can then wick up to the charge plate during the Standby condition (when jets of fluid are in catch with the eyelid closed), leading to a charge plate short failure.

Figure 1:
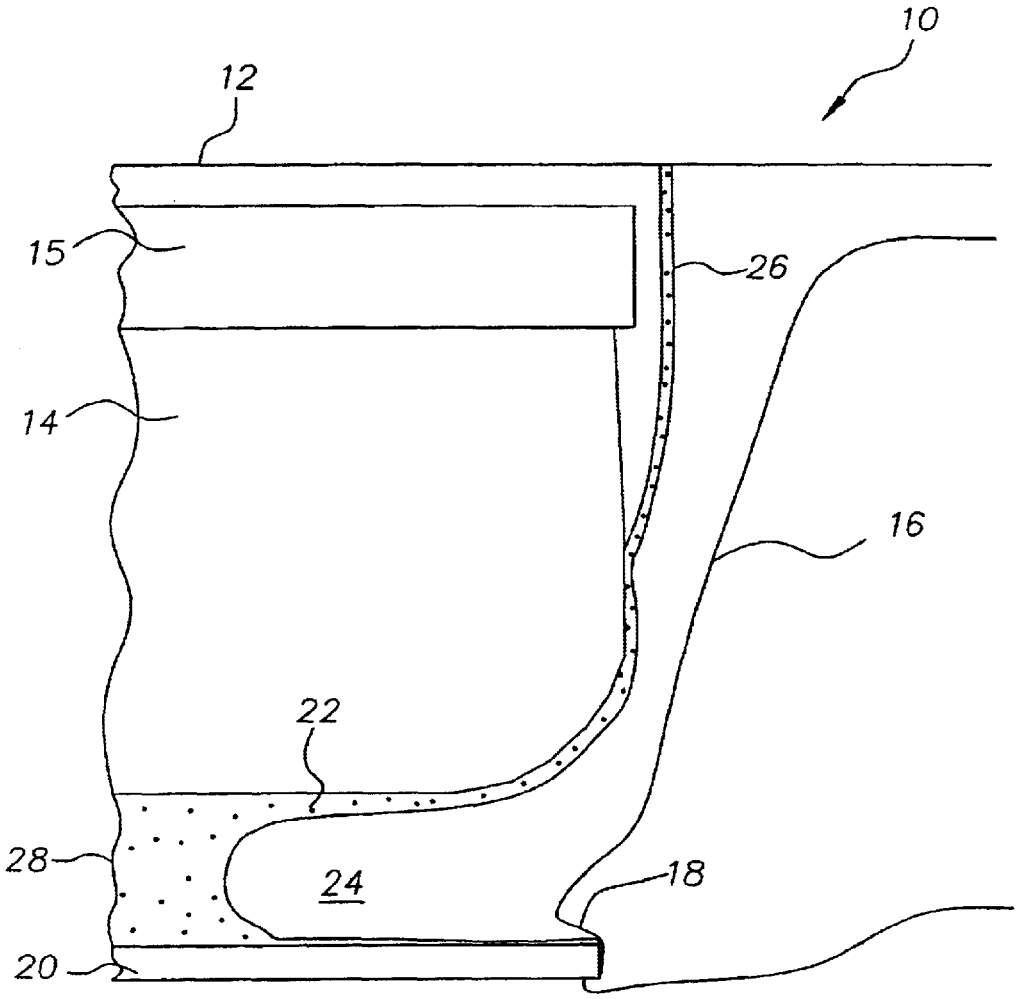
FIG. 1 (PRIOR ART)
FIG. 1 is a prior art side view of a printhead, illustrating the trajectory flow of uncharged ink droplets, diverted by the eyelid into the catcher fluid channel, as is done during startup.
Figure 5:
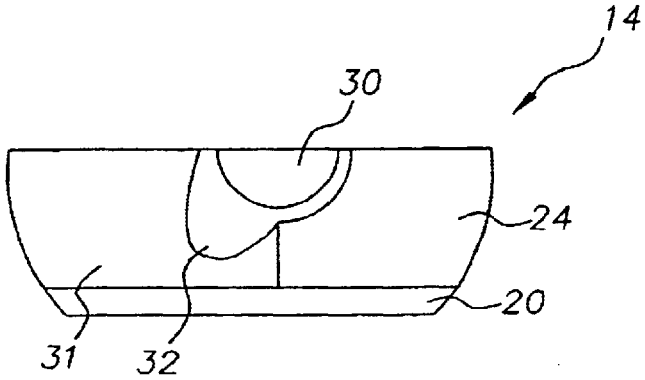
FIG. 5 shows the area below the catcher, to further illustrate the improved catcher design according to the present invention.

The present invention eliminates this failure by eliminating the ink bulges on the catcher face outside the catcher throat. This is accomplished by means of additional ink removal ports on the front of the catcher. In FIG. 1, there is illustrated a prior art view of a drop generator and catcher assembly 10. A drop generator 12 is situated in an area above a catcher 14 and charge plate 15, and an eyelid 16. When the eyelid is in the open position, ink drops are allowed to exit the printhead. When the eyelid is moved to the closed position, as shown in FIG. 1, the eyelid seal 18 presses against the bottom edge of the catcher pan 20 to contain ink 22 within the printhead on startup and shutdown of the printer system. The uncharged ink droplets flow along a trajectory path indicated by 26 in FIG. 1 and accumulate in a fluid channel 28 of the throat 24 of the catcher 14.

Figure 2:
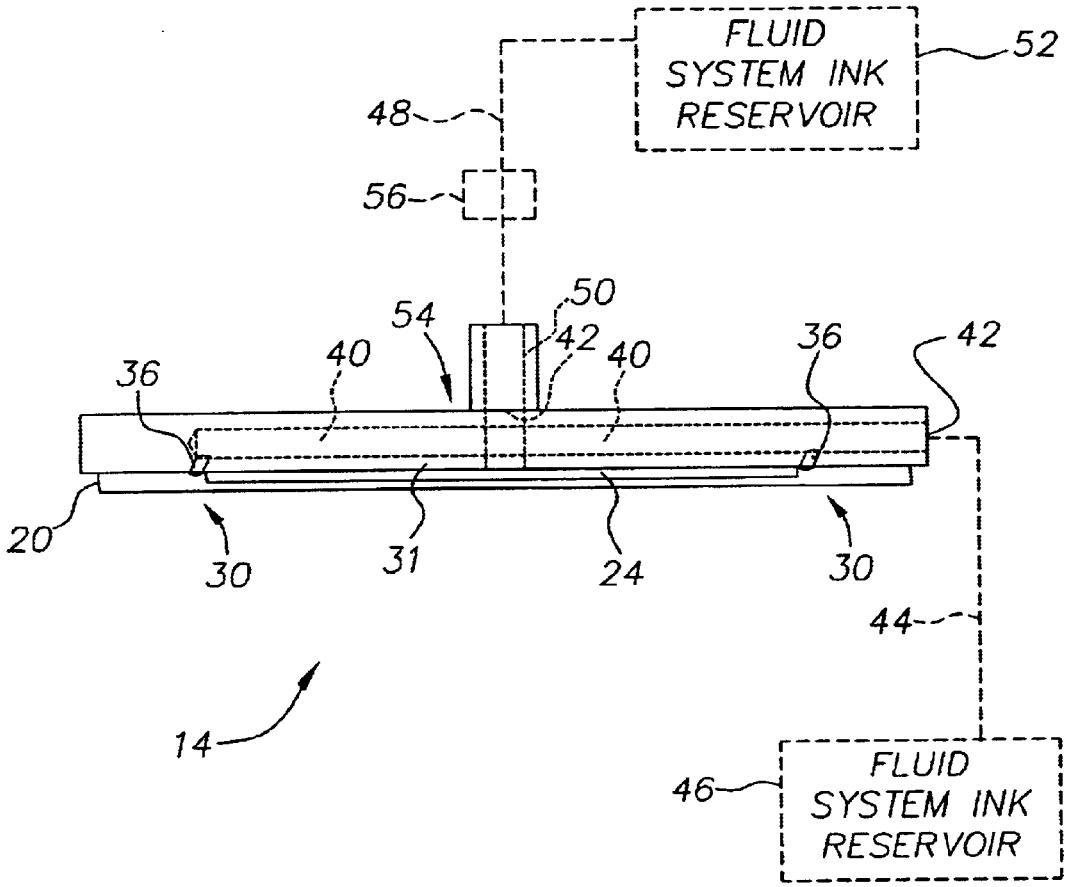
FIGS. 2, 3 and 4 illustrate various views of the improved catcher design associated with the printhead of FIG. 1, according to the present invention.
Figure 3:
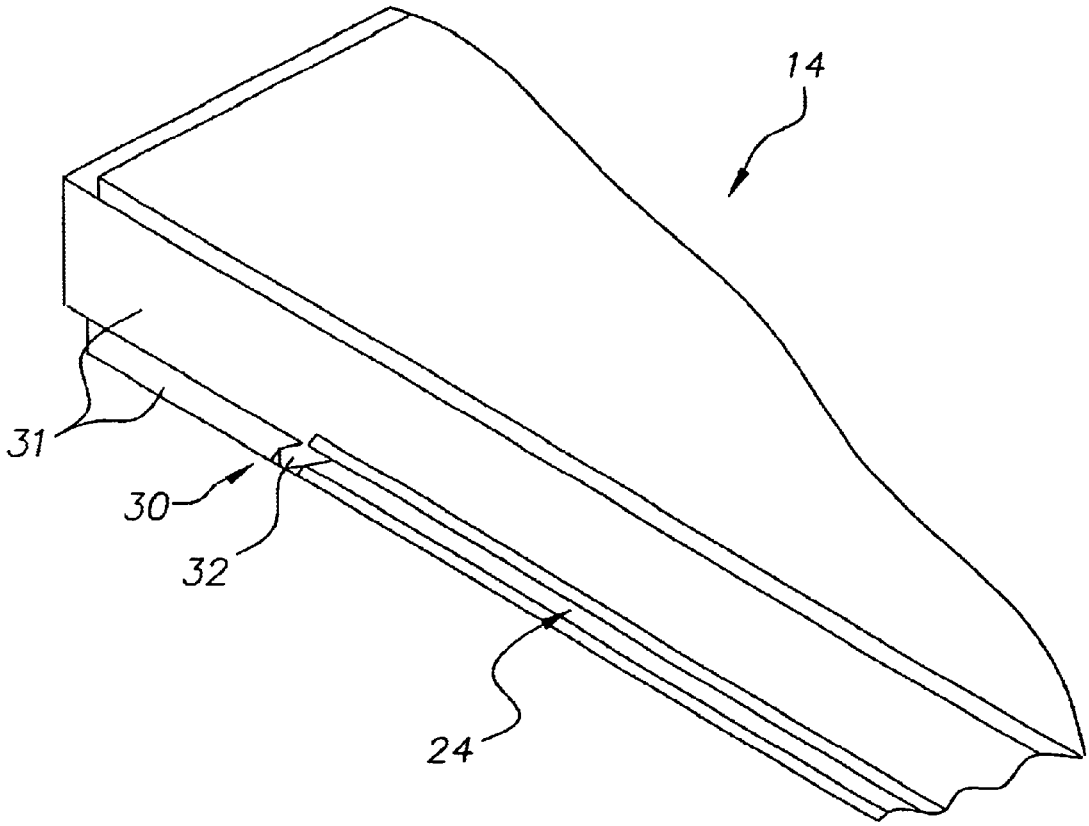
Figure 4:
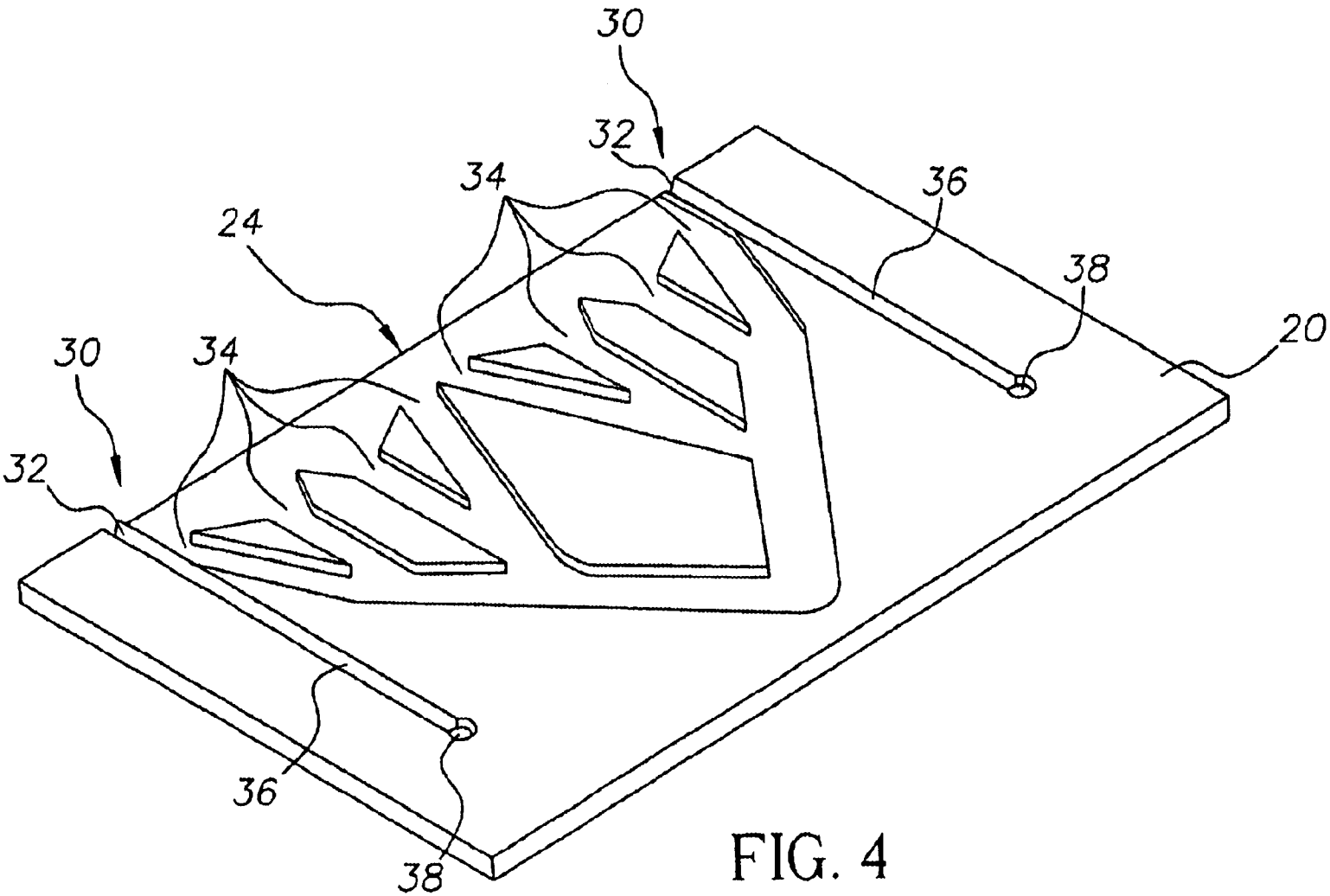
Figure 6:
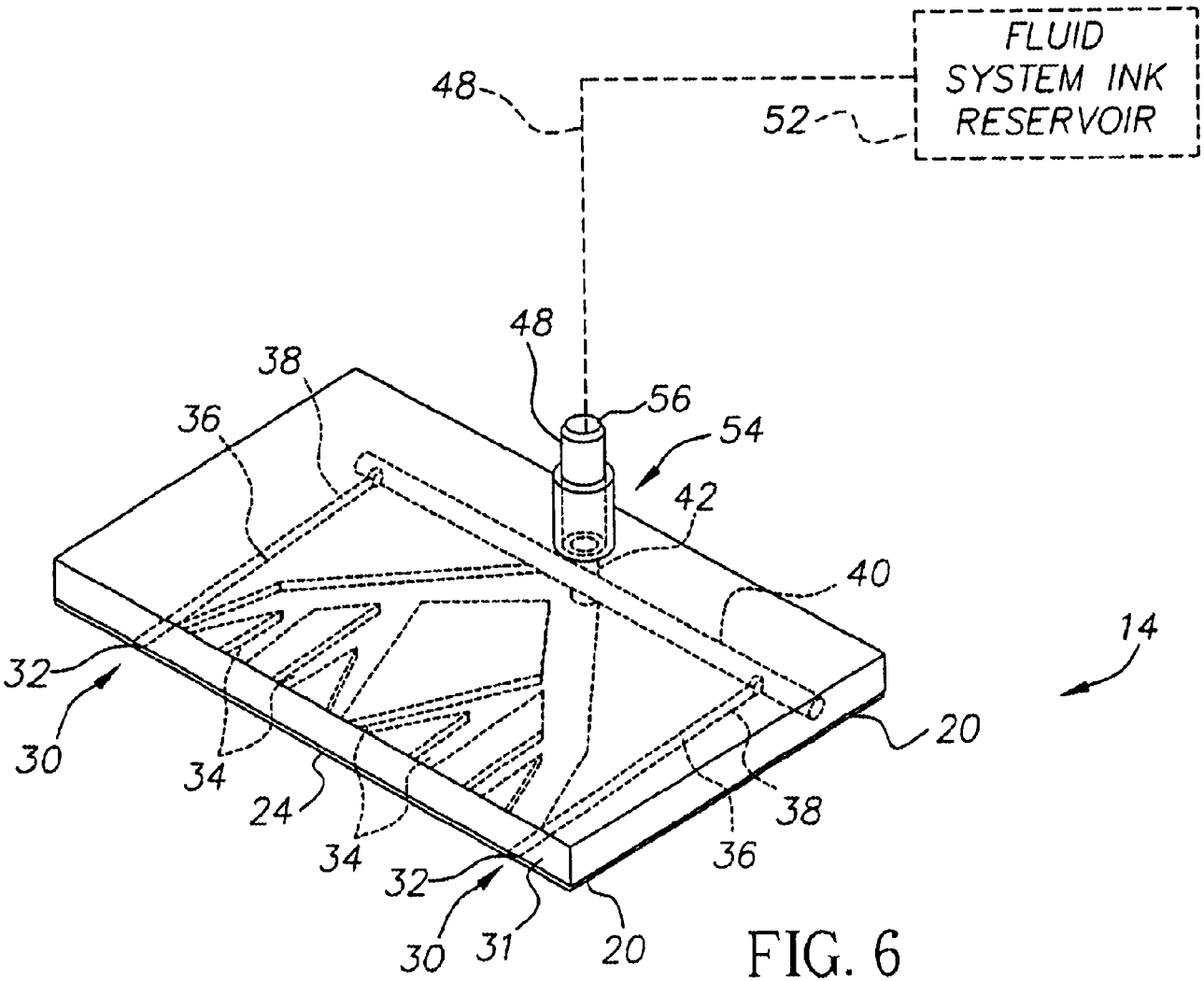
FIG. 6 shows a perspective view of a catcher made according to the present invention.

Referring now to FIGS. 2–6, the present invention eliminates the ink bulges on the catcher face outside the catcher throat 24 by means of ink removal port(s) 30 on the face 31 of the catcher 14. The ink removal port(s) 30 eliminate the ink on the face 31 of the catcher 14 through additional vacuum and increased flow through the removal port(s) 30. Ink that is below the catcher throat (24) is directed to an ink flow removal channel 40 by means of a machined channel 36 that is at, for example, a 30 degree angle into the face 31 of the catcher 14. Ink on the catcher face 31 and/or outside of the catcher throat flow channels 34 is drawn into the ink removal port(s) 30 by means of vacuum that is supplied to the ink removal port(s) 30. The channel 36 from the removal port(s) 30 sends the ink to an outlet 38 located in the catcher pan 20. The outlet 38 in the catcher pan 20, shown in FIG. 4, communicates within an ink flow removal channel 40 machined into the catcher, as best illustrated in FIG. 2. As such, angled channels 36 rising from the ink removal port(s) outlets connect with the larger ink flow removal channel 40 machined laterally in the catcher. An outlet 42 of the larger ink removal flow channel 40 can be connected to a vacuum source, not shown. By means of the ink removal port(s) 30 which may have scoop-like entrance regions 32, ink that wicks out onto the catcher face, or is sloshed there by the oscillations of the air-ink interface in the catcher throat (24), can be removed from the catcher face (31) before it has any adverse effect on printing.

For the removal of the ink from the catcher face 31, vacuum can be supplied by any suitable means. For example, in one embodiment of the present invention, the outlet 42 of the ink removal flow channel 40 in the catcher 14 can be connected by a fluid line 44 to the fluid system ink reservoir 46, which is maintained under vacuum. The ink removed from the catcher face can then be recycled back into the ink reservoir.

In another embodiment of the present invention, the outlet 42 of the ink removal flow channel 40 in the catcher 14 can be Tee'd in a manifold 54 into the fluid line 48 that returns ink from the catcher outlet 50 to the ink reservoir 52. Not only does this approach eliminate the need for an additional fluid return line, it can also help stabilize the air-ink interface in the catcher throat 24. That is, the oscillations of the air-ink interface can be reduced such that the sloshing of ink out of the catcher throat 24 onto the catcher face 31 is significantly reduced or eliminated.

The Tee'd in ink removal port(s) of this preferred embodiment, stabilize the air-ink interface by serving as an air bleed into the catcher return line 48. Without such an air bleed in the catcher return line, air needs to be drawn into the catcher return line 48 through the catcher throat 24, leading to an unstable air-ink interface. While this preferred embodiment serves as an air bleed to stabilize the air-ink interface in the catcher throat 24, the air ink interface can also be stabilized by the addition of one or more appropriately sized air bleed ports 54, that do not also serve to remove ink from the catcher face 31, into the catcher return line 48.

In printheads in which the presence of the problematic ink on the catcher face 31 in primarily the result of unstable air ink interface in the catcher throat 24, as opposed to the wicking of ink across the catcher face 31, (the relative significance of these two effects depends on the ink properties, particularly ink surface tension and viscosity) simple air bleed port(s) 54 in the catcher return line 48 may be an appropriate embodiment of the present invention to deal with the problem. In other printers, ink on the catcher face 31 outside of the catcher throat 24 may be solely the result of ink wicking. In such systems, ink removal port(s) 30 can be employed which return ink directly back to the ink reservoir (52, 46) without serving as air bleed port(s) 54 into the catcher return line 48.

Stabilizing the air-ink interface in the catcher throat 24 by means of the ink removal port(s) 30 or other air bleed port(s) 54 also allows the printing system to operate at a lower vacuum level than is typically possible. This lower vacuum level reduces the amount of evaporation in the fluid system ink reservoir 52, 46, reducing the amount of make-up fluid that is needed and also reducing the operating cost of the system. Finally, the lower evaporation rate reduces the amount of volatile organic compounds (VOCs) produced by the system.

In the preferred embodiment in which the ink removal port(s) are Tee'd into the catcher return line 48, proper ink removal from the ink removal port(s) and from the catcher throat 24 depend on providing appropriately balanced flow restrictions 56 in one or more of these flow channels. If the ink removal port(s) 30 are too small, there may be insufficient ink removal through port(s) to remove ink from the catcher face 31. The stabilization of the air ink interface in the catcher throat 24 also depends on the appropriate amount of air being drawn in through port(s) 30. If the ink removal port(s) are too large, the air ink interface in the ink removal port(s) 30 can become unstable, causing ink to slosh out of port(s) 30. Too large of ink removal port(s) also results in insufficient ink removal from the catcher throat 24 through the ink return line 48. The balanced restriction is critical for completing a successful start-up of the system. In inkjet printers that use a purge or flush fluid to remove ink from the catcher throat 24 at shutdown, it is desirable to also flush the ink out of the ink removal port(s) 30 with the same purge fluid. Failure to flush out these ports could cause ink to dry and plug these ports, making them ineffective.

The invention has been described in detail with particular reference to certain preferred embodiments thereof, but it will be understood that modifications and variations can be effected within the spirit and scope of the invention.

What is claimed is:

1. In an inkjet printer having a catcher with an associated catcher throat through which ink is returned to a fluid system reservoir, a method of preventing ink from wicking out of the catcher throat, the method comprising the steps of:

adding at least one vacuum channel to the catcher to remove ink to an ink removal port from a face of the catcher;

providing an additional fluid port on the catcher to allow the at least one vacuum channel to maintain an increased level of vacuum; and providing a tee to outlets of the ink removal port and the additional fluid port into a catcher return line to balance fluid flow between the catcher and the at least one vacuum channel.

2. A method as claimed in claim 1 further comprising the step of machining a scoop into a catch pan associated with the catcher to remove fluid from below the catcher throat.

3. A method as claimed in claim 1 further comprising the step of using a manifold to maintain a vacuum source for the catcher throat and the at least one vacuum channel, while pulling unprinted ink back to the fluid system.

4. A method as claimed in claim 1 further comprising the step of providing a restriction on a fluid line associated with the catcher to balance fluid flow between the catcher and the at least one vacuum channel.

5. A method as claimed in claim 1 further comprising the step of providing a fluid bleed port in fluid communication with the catcher return line.

6. In an inkjet printer having a catcher for collection of non-print ink drops and for returning collected ink to a fluid system, the catcher having an exterior catcher face for intercepting the non-print ink drops and a catcher throat into which ink on the catcher face flows for return to the fluid system, an improvement to prevent printer failure due to spreading of ink beyond ends of the catcher throat, the improvement comprising:

at least two ink removal ports on the exterior catcher face for removing ink that has spread beyond the ends of the catcher throat, and which each take in air in addition to ink;

an outlet for the at least two ink removal ports; and means to remove ink from the at least two ink removal ports at the outlet.

7. The improvement as claimed in claim 6 wherein the means to remove ink from the at least two ink removal ports at the outlet includes vacuum means supplied by the fluid system to the outlet for the at least two ink removal ports.

8. The improvement as claimed in claim 6 wherein the means to remove ink from the at least two ink removal ports at the outlet includes means for connecting the at least two ink removal ports from the outlet to an ink reservoir which is held under vacuum.

9. The improvement as claimed in claim 8 wherein the means for connecting the at least two ink removal ports from the outlet to an ink reservoir includes means for connecting the at least two ink removal ports to a single catcher return line associated with the catcher throat.

10. The improvement as claimed in claim 6 further comprising at least one air-bleed port into an ink flow return line for stabilizing an air-ink interface in the catcher throat so that perturbations in the air-ink interface do not deposit ink on the exterior catcher face beyond the ends of the catcher throat.

11. An inkjet printer having a cather for collection for non-print ink drops and for returning collected ink to a fluid system, the catcher having an exterior catcher face for intercepting the non-print ink drops and a catcher throat into which ink on the exterior catcher face flows for return to the fluid system, an improvement to prevent printer failure due to spreading of ink beyond ends of the catcher throat, the improvement comprising:

at least one air-bleed port into an ink flow return line for stabilizing an air-ink interface in the catcher throat so that perturbations in the air-ink interface do not deposit ink on the exterior catcher face beyond the ends of the catcher throat.

12. An improvement as claimed in claim 11 wherein the at least one air-bleed port includes at least two ink removal ports on exterior the catcher face for removing ink that has spread beyond the ends of the catcher throat.

13. In an inkjet printer having a catcher with an associated catcher throat through which ink is returned to the fluid system, a method for preventing ink from wicking out of the catcher throat, the method comprising the steps of:

teeing ink removal ports on a face of the catcher into an ink flow return line: and providing a vacuum to draw ink into the ink removal ports and to the ink flow return line.

14. A method as claimed in claim 13 teeing occurs at an outlet for the ink removal ports.

15. The improvement as claimed in claim 13 the teeing is to at an outlet for the ink removal ports.

16. In an inkjet printer having a catcher for collection of non-print ink drops and for returning collected ink to a fluid system, the catcher having an exterior catcher face for intercepting the non-print ink drops and a catcher throat into which ink on the catcher face flows for return to the fluid system, an improvement to prevent printer failure due to spreading of ink beyond ends of the catcher throat, the improvement comprising:

at least two ink removal ports on the exterior catcher face for removing ink that has spread beyond the ends of the catcher throat; and the at least two ink removal ports being teed to an ink flow return line.

* * * * *